US012043935B2

(12) United States Patent
Prüfer

(10) Patent No.: US 12,043,935 B2
(45) Date of Patent: Jul. 23, 2024

(54) PRESSER FOOT FOR PRODUCING A PIPING OR WELT

(71) Applicant: BERNINA International AG, Steckborn (CH)

(72) Inventor: Frank Prüfer, Hilzingen (DE)

(73) Assignee: BERNINA International AG, Steckborn (CH)

( * ) Notice: Subject to any disclaimer, the term of this patent is extended or adjusted under 35 U.S.C. 154(b) by 0 days.

(21) Appl. No.: 18/174,139

(22) Filed: Feb. 24, 2023

(65) Prior Publication Data

US 2023/0279596 A1 Sep. 7, 2023

(30) Foreign Application Priority Data

Mar. 25, 2022 (CH) ..... 000337/2022

(51) Int. Cl.
*D05B 29/06* (2006.01)
*D05B 3/10* (2006.01)

(52) U.S. Cl.
CPC ..... *D05B 29/06* (2013.01); *D05B 3/10* (2013.01)

(58) Field of Classification Search
CPC ..... D05B 29/00; D05B 29/02; D05B 29/04; D05B 29/06; D05B 29/08; D05B 29/10; D05B 29/12; D05B 3/10
See application file for complete search history.

(56) References Cited

U.S. PATENT DOCUMENTS

| | | | | | |
|---|---|---|---|---|---|
| 3,618,547 | A * | 11/1971 | Howell | D05B 3/18 | 112/240 |
| 3,858,538 | A * | 1/1975 | Van Amburg | D05B 29/08 | 112/235 |
| 4,892,047 | A * | 1/1990 | Fieschi | D05B 29/06 | 112/152 |
| 5,054,407 | A * | 10/1991 | Rowley | D05B 35/06 | 112/152 |
| 5,582,120 | A * | 12/1996 | Holl | D05B 29/06 | 112/240 |
| 9,631,306 | B2 * | 4/2017 | Shomura | D05B 29/08 | |
| 2016/0258094 | A1 * | 9/2016 | Shomura | D05B 29/08 | |

FOREIGN PATENT DOCUMENTS

| | | | | |
|---|---|---|---|---|
| CH | 673123 | A5 * | 2/1990 | D05B 29/06 |
| JP | H07272 | U * | 1/1995 | D05B 29/06 |
| JP | 2016163610 | A * | 9/2016 | D05B 29/06 |
| KR | 20220057919 | A * | 5/2022 | D05B 29/02 |

* cited by examiner

*Primary Examiner* — Danny Worrell
(74) *Attorney, Agent, or Firm* — Volpe Koenig

(57) ABSTRACT

A presser foot (1) for a sewing machine, having a shank (4) for fastening the presser foot (1) to a sewing machine, a needle opening (5) through which the sewing machine needle is able to be guided during sewing, and a presser foot sole (6) having an elongate depression (7) in the presser foot sole (6). The elongate depression (7) forms a guide wall which during sewing is configured to guide a filler material (8) to be sewn into the fabric (2) in the transport direction laterally beside the needle opening (5) and past the needle opening (5), and press said filler material against the fabric to be sewn, wherein the spatial extent of the elongate depression (7) is variably adjustable.

12 Claims, 3 Drawing Sheets

PRESSER FOOT FOR PRODUCING A PIPING OR WELT

CROSS-REFERENCE TO RELATED APPLICATIONS

This application claims priority from Swiss Patent Application No. CH000337/2022, filed Mar. 25, 2022, which is incorporated herein by reference as if fully set forth.

TECHNICAL FIELD

The invention relates to a presser foot for a sewing machine, for sewing a filler material into a fabric.

BACKGROUND

A seam which connects two tiers of fabric to each other can be embodied or designed in many different variants. One potential embodiment of such a seam is the piping or else the welt. Both the piping as well as the welt refer to a fold in the fabric which is filled by means of a filler material. The piping is often used as a decorative element in items of apparel, for example in uniforms, specifically for emphasizing the seam. However, the piping can also be used for reinforcing a seam, for example in edges of trouser pockets or seams of seat cushions. The welt in terms of embodiment or design is very similar to the piping but serves primarily for reinforcing edges of cloths or tarpaulins such that these edges can easily be introduced into a mounting and be fixedly held by the latter.

In the case of the piping, the filler material is typically a cord, a thick string, a rope or a filler string or round string based on plastics material. In the case of the welt, the filler material may also be a dimensionally stable rod or a dimensionally stable tube.

For producing a piping or a welt, respectively, the filler material is placed on a fabric, and the fabric is then folded about the filler material such that the fabric bears firmly on the filler material. The resultant two tiers of fabric are placed on top of each other close to the filler material and connected to each other. The connection of the two fabric tiers typically takes place by means of sewing, wherein the sewing is typically performed with the aid of a sewing machine. When sewing the fabric tiers it is critical inter alia that the fabric bears firmly on the filler material and the seam runs close to the filler material and at a specific spacing from the filler material.

Special sewing machine feet, or sewing machine presser feet, or presser feet, respectively, are known for producing a piping or a welt with a sewing machine. Said feet are also referred to as piping feet or welt cord feet, respectively. Such a piping foot or welt cord foot typically comprises a depression in the sole of the foot, which is configured to guide the filler material past the sewing machine needle while sewing such that a seam for connecting the two fabric tiers can be stitched next to the filler material encased by the fabric bearing firmly thereon by means of the sewing machine needle.

A typical piping foot or welt cord foot can only sew filler material of a specific spatial extent into a fabric. The specific spatial extent is established by the spatial extent of the depression in the sole of the foot.

For producing piping, cords with a cord diameter of 3 mm or 5 mm are sewn into a fabric, for example. If the sewing is performed by means of a sewing machine, for producing a piping using a cord which has a cord diameter of 3 mm, a first piping foot is used, the depression of the latter having a spatial extent matching this 3 mm cord. For producing a piping using a cord which has a cord diameter of 5 mm, another piping foot is used, the depression of the latter having a different spatial extent, the latter specifically matching the 5 mm cord. The same applies in an analogous manner to known welt cord feet.

In other words, piping feet or welt cord feet in the prior art can in each case process only one filler material size so as to form a piping or welt and are consequently less flexible in terms of their use.

SUMMARY

It is thus an object of the invention to provide a presser foot which makes it possible to produce a piping or welt by means of a sewing machine, and which can be used more flexibly in comparison to known piping feet or welt cord feet.

The object is achieved by a presser foot having one or more of the features disclosed herein. The preferred embodiments of the presser foot are disclosed below and in the claims.

The invention relates to a presser foot for a sewing machine, for pressing down a fabric to be sewn onto a stitch plate or onto a feed dog element of the sewing machine such that the fabric during sewing is able to be transported in a transport direction, having a shank for fastening the presser foot to a sewing machine, a needle opening through which the sewing machine needle is able to be guided during sewing, and a presser foot sole having an elongate depression in the presser foot sole, wherein the elongate depression along the longitudinal direction thereof extends laterally adjacent to the needle opening such that the longitudinal direction during sewing runs parallel to the transport direction, the elongate depression forms a guide wall which during sewing is configured to guide filler material to be sewn into the fabric in the transport direction laterally beside the needle opening and past the needle opening, and press said filler material against the fabric to be sewn, and the elongate depression has an extent L in the longitudinal direction, an extent B in the width, and an extent T in the depth, wherein the guide wall comprises a guide wall portion that is positionally fixed relative to the needle opening, and a guide wall portion that is displaceable relative to the needle opening, wherein the displaceable guide wall portion along a displacement direction is displaceable and lockable transversely to the longitudinal direction of the elongate depression such that one of the extents is variably adjustable by means of displacing and locking the displaceable guide wall portion.

The shank of the presser foot is typically fastened to the presser bar of a sewing machine. The presser bar is usually tensioned by means of a spring and presses the presser foot fastened thereto down onto the stitch plate, or the feed dog, such that a fabric to be sewn that lies between the presser foot sole and the stitch plate, or the feed dog, is able to be clamped and transported in the transport direction. In this way, the shank of the presser foot serves for fastening to a sewing machine, specifically such that the presser foot, as described above, is pressed down onto the stitch plate, or the feed dog, and the fabric to be sewn is able to be clamped and transported in the transport direction. For this purpose, the shank can have a receptacle for an end portion of the presser bar, the end portion being able to be introduced into said receptacle. The presser foot can then be able to be connected to the presser bar by means of being braced in relation to the end portion of the presser bar. Bracing can take place, for example, by means of a screw clamping installation or a tension lever installation.

During sewing, the needle opening enables the sewing needle to pierce the fabric to be sewn. The needle opening forms a clearance in the presser foot through which the sewing needle is able to be guided during sewing. The needle opening is typically designed such that said needle opening during sewing makes it possible for a plurality of needle positions to be guided through. At the same time, the needle opening is designed such that the fabric remains depressed when the sewing needle exits the fabric.

The presser foot sole is the part of the presser foot that during sewing has the smallest spacing from the fabric to be sewn, or is in direct contact with the latter. The presser foot sole comprises a face along which the fabric to be sewn is transported during sewing. The fabric to be sewn, by means of the presser foot sole, is able to be pressed down onto the stitch plate, or the feed dog, and able to be clamped such that the fabric to be sewn is able to be transported in the transport direction.

The elongate depression extends laterally beside the needle opening such that the sewing needle during sewing pierces the fabric to be sewn beside the elongate depression. This elongate depression can be configured so as to be semi-tubular in shape, for example.

The elongate depression forms a guide wall. This guide wall is designed such that filler material, which for producing a piping or a welt is to be sewn into the fabric to be sewn, during sewing is guided laterally beside the needle opening and past the needle opening.

When using a presser foot according to the invention for producing a piping or a welt, the filler material is typically placed onto the fabric to be sewn and the latter folded about the filler material so as to bear firmly thereon such that the filler material comes to lie between two fabric tiers. The filler material in this instance is encased by a tier of fabric, or sheathed by a tier of fabric. In order to close off the casing or sheathing, the two fabric tiers by means of sewing are connected to each other close to the filler material and at a specific spacing from the filler material. To this end, the filler material encased by a tier of fabric is guided into the elongate depression of the presser foot. As a result, the filler material, which is encased by a tier of the fabric to be sewn, during sewing and thus while transporting the fabric to be sewn, in the elongate depression is guided past the needle opening. At the same time, the two fabric tiers to be connected to each other are transported in the transport direction so as to pass through below the needle opening such that the two fabric tiers beside the filler material are able to be penetrated by the sewing needle and the two fabric tiers in this way are able to be connected by means of sewing.

The guide wall is furthermore configured to press the filler material against the fabric to be sewn, thus against the one encasing fabric tier such that the filler material is able to be transported conjointly with the fabric to be sewn.

The extent L corresponds to the length in the longitudinal direction of the depression. The extent T corresponds to the depth of the depression, specifically in a direction transverse to the presser foot sole. The extent B corresponds to the width of the depression, specifically in a direction transverse to the depth and to the length. The extent here refers to the spatial extent of the depression.

The guide wall comprises a guide wall portion which is positionally fix relative to the needle opening. Positionally fixed here means that the position of this guide wall portion relative to the needle opening is fixed, or established, respectively.

The guide wall also comprises a displaceable guide wall portion which is displaceable relative to the needle opening. Displaceable means that this guide wall portion, thus the position thereof, is displaceable relative to the needle opening.

The displacement capability here is provided along a displacement direction which runs transversely to the longitudinal direction of the elongate depression.

The displaceable guide wall portion is lockable. Lockable here means that the displaceable guide wall portion, from a state in which the latter is displaceable, is able to be brought to a locked state in which the displaceable guide wall portion, in terms of the displacement capability thereof, is arrested or blocked or disabled, respectively. The displaceable guide wall portion is likewise able to be brought from a locked state to a state in which said displaceable guide wall portion is displaceable.

The displaceable guide wall portion is displaceable such that an extent of the elongate depression is variably adjustable by means of displacing and locking the displaceable guide wall portion. An extent here relates to one of the extents L, B, and T. Variably adjustable means that an extent is differently adjustable, or variably adjustable. That is to say that the extent is differently adjustable, or the extent is variably adjustable by means of displacing and locking the displaceable guide wall portion. For example, the extent B by means of displacing and locking the displaceable guide wall portion is adjustable to a first width and a second width, wherein the first and the second width are dissimilar. The same also applies in an analogous manner to the other extents.

The spatial extent of the depression can be variably adjusted by providing a displaceable guide wall portion. As a result, it is possible to adapt the presser foot according to the invention to the spatial extent of the filler material to be sewn in. In this way, the presser foot according to the invention can be used flexibly and renders superfluous the provision of a plurality of presser feet for sewing in filler materials with dissimilar spatial extents and also the associated changing of the presser foot.

By providing a positionally fixed guide wall portion, the variable adjustment capability of the spatial extent of the depression by means of displacing the displaceable guide wall portion relative to the positionally fixed guide wall portion is made possible in a simple manner, and the guide wall is kept stable at the same time. As a result of only one guide wall portion being displaceable, the presser foot can also be more easily produced.

Proceeding from piping feet or welt cord feet of the prior art it can be seen that it has been recognized in a first inventive step that it is disadvantageous to provide such piping feet or welt cord feet that are in each case configured only for sewing in a filler material with a specific spatial extent.

In a second inventive step it has been recognized that it is worthwhile to design the depression, which during sewing guides the filler material past the sewing needle, such that the spatial extent of said depression is variable or adjustable and in this way can be adapted to different spatial extents of a filler material.

In a third inventive step, it has been recognized that this variable adjustment capability can be provided in that the guide wall has a positionally fixed guide wall portion and a displaceable guide wall portion.

According to one embodiment of the presser foot, the extents B and T are variably adjustable by means of displacing and locking the displaceable guide wall portion.

That is to say that according to this embodiment, the extent B as well as the extent T are variably adjustable. As a result, the spatial extent of the depression in two dimensions is able to be adapted to the spatial extent of the filler material. This results in optimal guiding of the filler material, independently of the set spatial extent of the depression. In particular, the one fabric tier which encases the filler material is, as a result, pressed firmly against the filler material, independently of the set spatial extent of the depression.

According to one embodiment of the presser foot, the positionally fixed guide wall portion has a plane, and the displacement direction runs parallel to this plane, wherein the displaceable guide wall portion is displaceable along this plane.

This plane and the shank can enclose an angle W of $0° \leq W \leq 90°$, preferably of $20° \leq W \leq 70°$, furthermore preferably of $30° \leq W \leq 60°$, furthermore preferably of $40° \leq W \leq 50°$, in particular of 45°.

It is achieved as a result that the displaceable guide wall portion is displaceable by means of a simple displacement movement. In this way, the presser foot can be used in a flexible manner and handled in a simple manner.

According to one further embodiment of the presser foot, the positionally fixed guide wall portion extends between the displaceable guide wall portion and the needle opening, wherein the positionally fixed guide wall portion during sewing is configured to guide the filler material past the needle opening at a specific spacing from the needle opening.

It is achieved as a result that the two fabric tiers to be connected are able to be penetrated by the sewing needle at a specific spacing from the filler material, specifically independently of the spatial extent of the filler material. This leads to an improved, more uniform closure of the piping or of the welt, respectively.

According to one embodiment of the presser foot, the displaceable guide wall portion along the displacement direction is displaceable towards the positionally fixed guide wall portion and/or away from the positionally fixed guide wall portion.

It is achieved as a result that the spatial extent of the depression is at all times adjustable such that the filler material is pressed against the positionally fixed wall portion. This results in improved controllable guiding of the filler material.

According to one embodiment of the presser foot, the presser foot has a displacement apparatus having a guide which is fastened to the presser foot, and a slider element which is guided in the guide, wherein the displaceable guide wall portion is configured on the slider element such that the displaceable guide wall portion is displaceable by means of displacing the slider element.

The guide can be a linear guide, for example. In this instance, the linear guide extends along the displacement direction and parallel to the latter. The linear guide can be configured in the shape of a groove.

The slider element can be sized such that said slider element is able to be guided in the linear guide, in particular in the groove-shaped guide.

The slider element can be designed such that the width of the slider element matches the width of the groove-shaped guide, specifically such that the slider element is able to be guided in the groove-shaped guide.

The slider element can be designed such that the thickness of the slider element matches the height of the groove-shaped guide, specifically such that the slider element is able to be guided in the groove-shaped guide.

The slider element can be designed such that the width and the thickness of the slider element match the width and the height of the groove-shaped guide, specifically such that the slider element is able to be guided in the groove-shaped guide.

It is achieved as a result that the displaceable guide wall portion is displaceable in a simple and controllable manner along the displacement direction.

According to one embodiment of the presser foot, the displaceable guide wall portion and the slider element are designed such that the displaceable guide wall portion is able to be removably fastened to the slider element.

It is achieved as a result that the displaceable guide wall portion is replaceable. Dissimilar guide wall portions can thus be fastened to the slider element. Guide wall portions that are able to be fastened in this way can differ in terms of their frictional characteristics or wear characteristics, for example. This renders the presser foot so as to able to be used and adapted in a flexible manner.

According to one embodiment of the presser foot, the slider element has male or female plug elements, and the displaceable guide wall portion has mutually corresponding female or male plug elements, wherein the displaceable guide wall portion and the slider element are able to be plugged into each other by means of the plug elements.

A male plug element can be a projecting element. The projecting element can be configured in the shape of a pin, for example. A male plug element is configured to be plugged into a female plug element.

A female plug element forms a receptacle for a male plug element and is designed such that the male plug element is able to be plugged into the receptacle. The female plug element can be a depression which is designed such that a male plug element configured as a projecting element is able to be plugged into the depression.

Such a plug connection enables the guide wall portion to be connected to the slider element in a simple and reliable manner. This renders the presser foot so as to be able to be used and adapted in a flexible manner.

According to one embodiment of the presser foot, the presser foot has a latching device, wherein the displaceable guide wall portion is lockable by means of the latching device.

It is achieved as a result that the displaceable guide wall portion is able to be locked in a simple and reliable manner. In this way, simple and reliable adapting of the presser foot to the filler material to be sewn in is made possible.

According to one embodiment of the presser foot, the latching device comprises a first latching element and a second latching element, wherein the first latching element is configured on the slider element, and the second latching element is configured on the guide, and the first latching element is able to latch onto the second latching element.

The first or the second latching element can be a pivotably mounted rocker, wherein a projecting, hook-shaped element is configured on one end of the rocker. With a force acting thereon, the rocker is pivotable from a resting position, wherein a restoring force that pushes the rocker back to the resting position thereafter acts on the rocker.

The first or the second latching element can be formed by hook-shaped depressions which in each case correspond to the projecting, hook-shaped element, wherein these hook-shaped depressions are designed such that the projecting, hook-shaped element of the rocker is able to latch into a corresponding hook-shaped depression.

For latching, the end of the rocker having the projecting, hook-shaped element under the action of a force is pivoted from the resting position. The projecting, hook-shaped element is thereafter positioned relative to a corresponding hook-shaped depression such that the projecting, hook-shaped element of the rocker, by means of the restoring force, is able to be latched into the corresponding hook-shaped depression.

It is achieved as a result that the locking action can take place in a simple and reliable manner. It is made possible in this way that the presser foot is adapted in a simple and reliable manner to the filler material to be sewn in.

According to one embodiment of the presser foot, the displacement direction and the shank enclose an angle W of $0° \leq W \leq 90°$, preferably of $20° \leq W \leq 70°$, furthermore preferably of $30° \leq W \leq 60°$, furthermore preferably of $40° \leq W \leq 50°$, in particular of 45°.

It is achieved as a result that the displaceable guide wall portion is displaceable by means of a simple displacement movement. In this way, the presser foot is able to be handled in a flexible and simple manner.

According to one embodiment of the presser foot, the slider element has a handle.

It is achieved as a result that the displaceable guide wall portion is able to be displaced in a simple manner. In this way, the presser foot is easy to handle and has positive usage properties.

The handle can extend along the displacement direction and project from the slider element in a direction away from the depression.

BRIEF DESCRIPTION OF THE DRAWINGS

The presser foot according to the invention is described in more detail hereunder purely by way of example by means of specific embodiments illustrated in the figures, in which.

DETAILED DESCRIPTION

Figure 1:
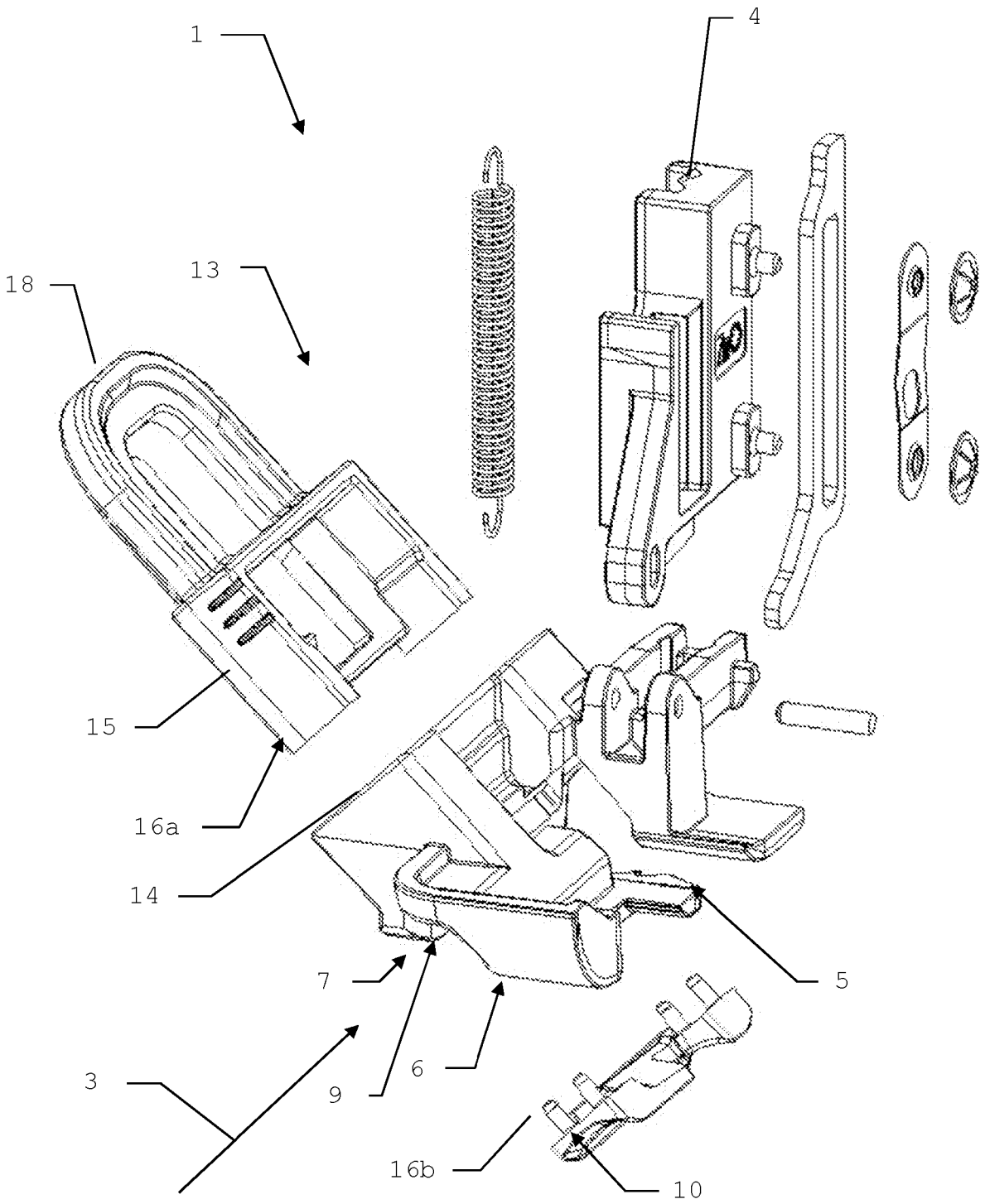
FIG. 1 shows a perspective view of an embodiment of a presser foot according to the invention in an exploded illustration.

FIG. 1 shows a perspective view of an embodiment of a presser foot 1 according to the invention. The presser foot 1 comprises a shank 4. The shank 4 is able to be fastened to a presser bar of a sewing machine. To this end, the shank 4 has a receptacle into which an end portion of a presser bar is able to be introduced and in which the end portion of the presser bar is able to be fixed. The presser foot 1 shown also comprises a presser foot sole 6 which is connected to the shank 4 so as to be pivotable about an axis. The presser foot 1 shown comprises a needle opening 5 through which the sewing machine needle is able to be guided during sewing. The presser foot 1 comprises an elongate depression 7 in the presser foot sole 6, wherein this elongate depression 7 forms a guide wall. When sewing a piping or a welt, this guide wall guides a filler material 8 to be sewn into a fabric beside the needle opening 5 and past the needle opening 5. The guide wall, fastened to a presser bar, presses the fabric 2 to be sewn against the filler material 8. The elongate depression 7 has an extent L in the longitudinal direction, an extent B in the width, and an extent T in the depth. The guide wall comprises a positionally fixed guide wall portion 9, and a guide wall portion 10 which is displaceable relative to the needle opening 5. The displaceable guide wall portion 10 along a displacement direction 11 is displaceable transversely to the longitudinal direction of the depression 7. To this end, the displaceable guide wall portion 10 is removably fastened to a slider element 15. For removable fastening, the displaceable guide wall portion 10 has male plug elements **16*b* in the form of projecting pin-shaped elements, and the slider element 15 has female plug elements in the form of depressions which are designed such that the pin-shaped elements are able to be plugged into the depressions. A handle 18 which enables the displaceable guide wall portion 10 to be easily displaced is configured on the slider element 15. The presser foot 1 comprises a latching device 17 by means of which the displaceable guide wall portion 10** is able to be locked.

Figure 2:
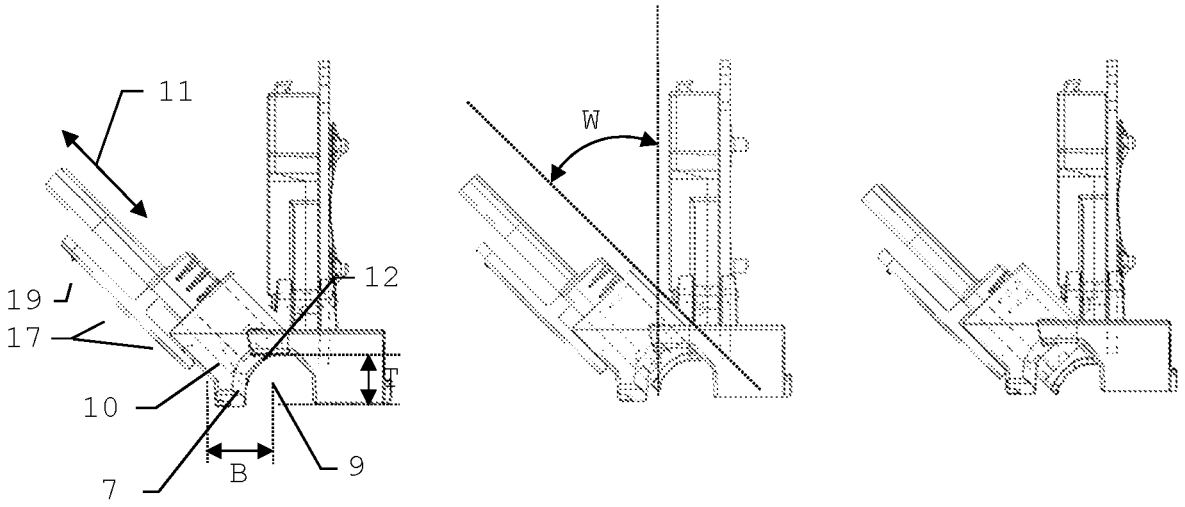
FIG. 2 shows three front views of the embodiment of a presser foot according to the invention shown in FIG. 1, wherein each of the three front views shows the presser foot having dissimilarly adjusted extents B and T of the elongate depression.

FIG. 2 shows three front views of the embodiment of a presser foot 1 according to the invention shown in FIG. 1, wherein each of the three front views shows the presser foot 1 having dissimilarly adjusted extents B and T of the elongate depression 7. The slider element 15, the handle 18 configured thereon, and a rocker 19 configured on the slider element 15 are shown in the three front views of the presser foot 1. The rocker 19 comprises a hook-shaped element which is able to be latched into a hook-shaped depression that is configured on the guide 14. The guide 14 comprises a plurality of such hook-shaped depressions. By pressing on the end of the rocker 19 that lies opposite the end with the hook-shaped element, the rocker 19 is pivotable from the resting position. The slider element 15, with the rocker 19 in a position pivoted from the resting position, is able to be displaced along the displacement direction 11. The hook-shaped element of the rocker 19 in the process is able to be positioned relative to a hook-shaped depression such that the hook-shaped element of the rocker 19, when releasing the depressed end of the rocker 19, is able to be latched into the corresponding hook-shaped depression. Furthermore, the three front views show the elongate depression 7 in the presser foot sole 6. The guide wall formed by the elongate depression 7 comprises a plane 12 along which the displaceable guide wall portion 10 is displaceable such that the extents B and T of the elongate depression 7 are adjustable. The displaceable guide wall portion 10 shown is displaceable along a displacement direction 11 which conjointly with the shank 4 encloses an angle W of 45°.

Figure 3:
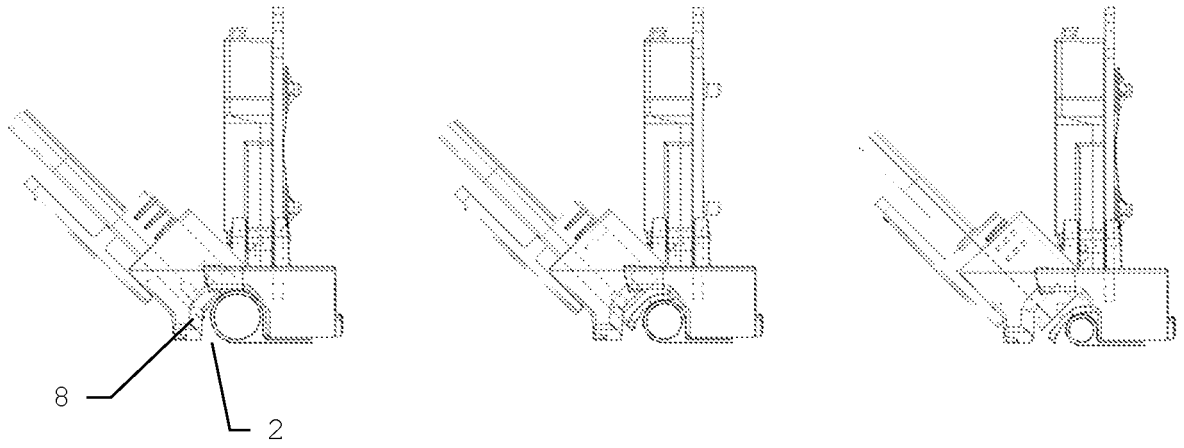
FIG. 3 shows the three front views of FIG. 2, each having a filler material guided in the elongate depression.

FIG. 3 shows the three front views of FIG. 2, each having a filler material 8 which is guided in the elongate depression 7. The filler material 8 is encased by a tier of the fabric 2 to be sewn, wherein the encasing layer of fabric bears firmly on the filler material 8. The two tiers of fabric to be connected by means of sewing come to lie on top of each other, close to the filler material 8. The positionally fixed guide wall portion 9 enables the sewing needle to penetrate the two fabric tiers at a specific spacing from the filler material 8. A piping or a welt is able to be produced connecting the two fabric tiers shown in FIG. 3 by means of sewing.

The invention claimed is:

1. A presser foot for a sewing machine, for pressing down a fabric to be sewn onto a stitch plate or onto a feed dog element of the sewing machine such that the fabric during sewing is transportable in a transport direction, the presser foot comprising:

a shank configured to fasten the presser foot to a sewing machine;

a presser foot sole having an elongate depression in the presser foot sole;

a needle opening through which the sewing machine needle is able to be guided during sewing;

the elongate depression in the presser foot sole along a longitudinal direction thereof extends laterally adjacent to the needle opening such that the longitudinal direction during sewing extends parallel to the transport direction;

the elongate depression forms a guide wall which during sewing is configured to a) guide a filler material to be sewn into the fabric to be sewn in the transport direction laterally beside the needle opening and past the needle opening, and b) press said filler material against the fabric to be sewn;

the elongate depression has an extent L in the longitudinal direction, an extent B in the width, and an extent T in the depth;

the guide wall comprises a guide wall portion that is positionally fixed relative to the needle opening and a guide wall portion that is displaceable relative to the needle opening and the displaceable guide wall portion is displaceable along a displacement direction and lockable transversely to the longitudinal direction of the elongate depression such that one of the extents of the elongate depression is variably adjustable by displacement and locking the displaceable guide wall portion.

2. The presser foot according to claim 1, wherein the extent B and the extent T are variably adjustable by displacement and locking the displaceable guide wall portion.

3. The presser foot according to claim 1, wherein the positionally fixed guide wall portion has a plane, the displacement direction runs parallel to the plane, and the displaceable guide wall portion is displaceable along the plane.

4. The presser foot according to claim 1, wherein the positionally fixed guide wall portion extends between the displaceable guide wall portion and the needle opening, and the positionally fixed guide wall portion during sewing is configured to guide the filler material past the needle opening at a specific spacing from the needle opening.

5. The presser foot according to claim 1, wherein the displaceable guide wall portion along the displacement direction is displaceable at least one of towards the positionally fixed guide wall portion or away from the positionally fixed guide wall portion.

6. The presser foot according to claim 1, further comprising:

a displacement apparatus having a guide, and a slider element which is guided in the guide; and the displaceable guide wall portion is configured on the slider element such that the displaceable guide wall portion is displaceable by displacement of the slider element.

7. The presser foot according to claim 6, wherein the displaceable guide wall portion and the slider element are configured such that the displaceable guide wall portion is removably fastenable to the slider element.

8. The presser foot according to claim 7, wherein the slider element has male or female plug elements, and the displaceable guide wall portion has mutually corresponding female or male plug elements, and the displaceable guide wall portion and the slider element are pluggable into each other via the plug elements.

9. The presser foot according to claim 1, further comprising a latching device, and the displaceable guide wall portion (10) is lockable by the latching device.

10. The presser foot according to claim 9, wherein the latching device comprises a first latching element and a second latching element, the first latching element is configured on the slider element, and the second latching element is configured on the guide, and the first latching element is latchable onto the second latching element.

11. The presser foot according to claim 1, wherein the displacement direction and the shank enclose an angle W of $0° \leq W \leq 90°$.

12. The presser foot according to claim 6, wherein the slider element has a handle.

* * * * *